United States Patent [19]

Johnston

[11] Patent Number: 4,498,723

[45] Date of Patent: Feb. 12, 1985

[54] ELECTRICAL CONNECTOR AND METHOD FOR TERMINATING SOLID CONDUCTORS

[75] Inventor: James J. Johnston, Old Saybrook, Conn.

[73] Assignee: Brand-Rex Company, Willimantic, Conn.

[21] Appl. No.: 452,780

[22] Filed: Dec. 23, 1982

[51] Int. Cl.[3] ..... H01R 13/39

[52] U.S. Cl. ..... 339/97 P

[58] Field of Search ..... 339/97 R, 97 P, 98, 339/99 R

[56] References Cited

U.S. PATENT DOCUMENTS 4,211,462 7/1980 Wolfthal ..... 339/97 R

*Primary Examiner*—Joseph H. McGlynn

*Attorney, Agent, or Firm*—McCormick, Paulding & Huber

[57] ABSTRACT

A plurality of solid electrical conductors arranged in parallel relation within a connector element are terminated by electrical contacts having generally V-shaped tines received in pre-pierced pilot holes in the conductors and assembled in press fit engagement with the conductors within the pilot holes.

28 Claims, 14 Drawing Figures

ELECTRICAL CONNECTOR AND METHOD FOR TERMINATING SOLID CONDUCTORS

BACKGROUND OF THE INVENTION

This invention relates in general to electrical connectors and methods for terminating electrical conductors and deals more particularly with improved electrical connector elements and methods for effecting high density termination of solid electrical conductors.

Technological advances in the fields of electronics and telecommunications have created need for improved miniaturized connector assemblies and methods for effecting high density termination of electrical conductors. Such miniaturized connector assemblies as have been heretofore available usually include electrical contacts having connecting portions which engage associated peripheral surface portions of the conductors to which they are attached. One type of contact, adapted to be crimped into electrical engagement with a bare end portion of an associated conductor, includes a connecting portion which at least partially surrounds the bare end portion of the conductor. Another type of contact of an insulation displacement type, commonly used in such miniaturized connectors, includes two or more opposing tines which straddle an insulated electrical conductor, displace the insulation on the conductor, and engage or incise generally laterally opposite portions of the peripheral surface of the conductor. Still another contact of the insulation displacement type has a single wedge-shaped tine for forcing an insulated conductor against an abutment surface of an associated connector element and incising the insulation on the conductor to establish electrical contact with the conductor. The connecting portion of such contacts usually have lateral dimensions substantially greater than the lateral dimensions of the associated solid conductors to which they are connected. Such contacts, when mounted within a connector element housing are necessarily insulated from each other and may be separated by associated portions of the connector housing. The connecting portions of the contacts, which comprise the widest portions of each contact-conductor assembly, impose limitations on the size of a connector element which may be used to terminate conductors of a given gauge.

It is the general aim of the present invention to provide improved electrical connector elements and methods for terminating solid electrical conductors which overcome, or at least substantially reduce, the aforesaid problems.

SUMMARY OF THE INVENTION

In accordance with the present invention an electrical cable which includes a plurality of axially elongated solid electrical conductors is terminated by a connector element which includes a hollow housing and a plurality of electrical contacts supported within the housing. Each contact has at least one tine and includes a contact surface exposed externally of the housing. Portions of the conductors which comprise the cable are disposed in parallel relation within the housing and have pre-formed tine receiving openings therein. The tines are assembled in press fit relation with the conductors within the pre-formed openings.

DETAILED DESCRIPTION OF PREFERRED EMBODIMENTS AND METHODS

Figure 1:
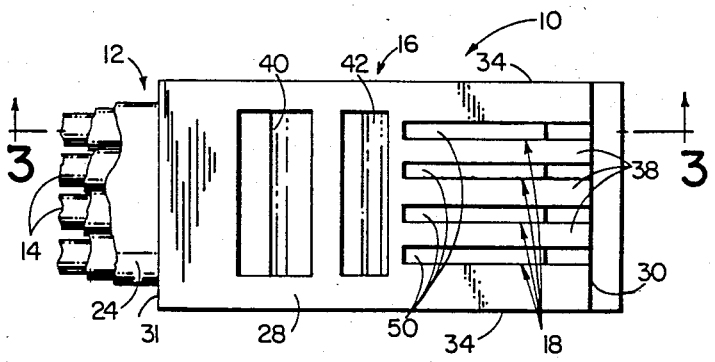
FIG. 1 is a plan view of an electrical connector element embodying the invention and shown connected in terminating relation to an electrical cable containing a plurality of solid electrical conductors.
Figure 2:
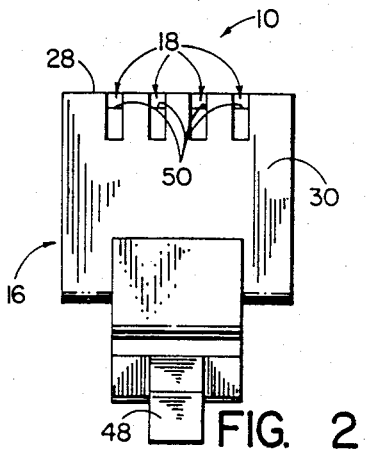
FIG. 2 is a front view of the electrical connector element of FIG. 1.

Turning now to the drawings and referring first particularly to FIGS. 1–4, a high density electrical connector element embodying the present invention, and indicated generally by the reference numeral 10, is shown connected to an associated electrical cable, indicated generally at 12, containing a plurality of individual solid electrical conductors 14, 14 terminated in accordance with a method of the invention. The illustrated electrical connector 10 comprises a male element or plug and forms part of an electrical connector assembly which includes a mating female connector element (not shown). The connector element 10 has a hollow body or housing, indicated generally at 16, and contains a plurality of individual electrical contacts, designated generally by the numerals 18, 18 and arranged in inline relations within the housing 16. Each contact 18 has at least one tine 20 which is received in press fit engagement within a pre-formed opening 22 in an associated one of the conductors 14, 14, as will be hereinafter further discussed.

The connector element 10 is particularly adapted for terminating portions of solid electrical conductors insulated from each other and arranged in side-by-side parallel relation within the connector element, and wherein the center distance between adjacent conductor portions does not exceed 0.050 inches. Thus, for example, where each conductor portion is individually insulated and has a 0.040 inch outside diameter, immediately adjacent terminated conductor portions may be arranged on 0.040 inch centers within an associated connector element.

The invention may be practiced with electrical cables of various types, however, the illustrated connector element 10 is particularly adapted for terminating a flat or ribbon cable, such as the cable 12, which has an outer insulation jacket 24 containing the conductors 14, 14. The conductors 14, 14 are arranged in adjacent parallel relation within the jacket 24. Each conductor 14 has a surrounding layer of insulation 26.

Figure 3:
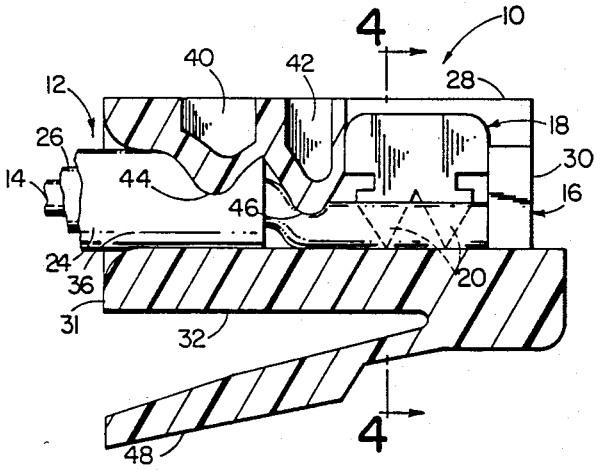
FIG. 3 is a sectional view through the connector element taken along the line 3—3 of FIG. 1.

Further considering the connector element 10, the body 16 is preferably molded from dielectric plastic material and includes a top wall 28, a front wall 30, a rear wall 31, a bottom wall 32 and side walls 34, 34 which cooperate to define a cavity 36, which opens through the rear wall 31. A plurality of integral, vertically disposed and laterally spaced apart insulating partitions or spacers 38, 38 define portions of the top wall 28 and the front wall 30, project downwardly for some distance into the cavity 36, and terminate above and in spaced relation relative to the bottom wall 32. Laterally extending recesses 40 and 42 which open through the top wall 28 are further defined by strain relief portions of the body indicated at 44 and 46 which extend between the side walls 34, 34, as best shown in FIGS. 1 and 3. A resilient latch tab 48 integrally connected to the bottom wall 32 has rearwardly facing abutment surfaces thereon (not shown) for cooperating with associated abutment surfaces on a female connecting element to releasably retain the male element 10 in connected relation to the female connector element, in a manner well known in the art.

Figure 4:
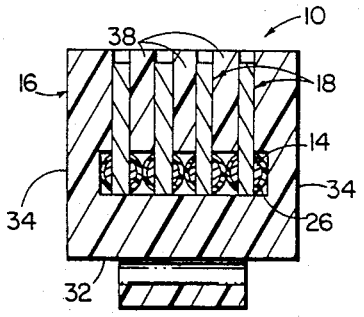
FIG. 4 is a sectional view taken along the line 4—4 of FIG. 3.
Figure 5:
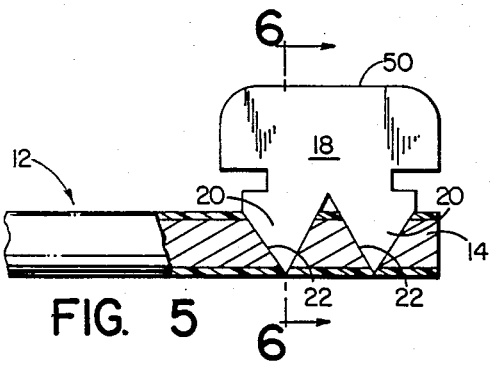
FIG. 5 is a somewhat enlarged fragmentary axial sectional view through a typical conductor shown with a contact attached thereto.
Figure 6:
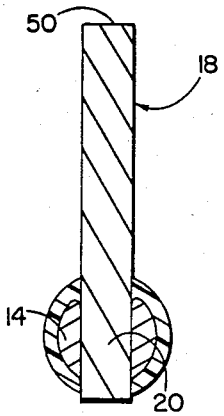
FIG. 6 is a somewhat further enlarged sectional view taken along the line 6—6 of FIG. 5.

A typical contact 18, best shown in FIGS. 5 and 6, is preferably stamped from flat metal and has two V-shaped tines 20, 20 and an upwardly facing contact surface 50. The width of each contact 18 is preferably substantially equal to the spacing between a pair of adjacent insulating partitions 38, 38, as best shown in FIG. 4.

Preparatory to terminating the cable 12, a portion of the outer insulation jacket 24 is stripped from the cable to expose portions of the individually insulated electrical conductors 14, 14. The prepared portion of the cable 12 which, as shown, comprises an end portion, is inserted into the cavity 36 through the opening in the rear wall 31. Pre-pierced openings or pilot holes 22, 22 are formed in the prepared portions of the conductors 14, 14. More specifically, pilot holes or slots 22, 22 which extend axially of the conductors 14, 14 are pierced into each of the insulated end portions of the conductors. The holes or slots 22, 22 in each insulated conductor 14 are preferably V-shaped to generally complement the tines on an associated contact 18.

Figure 7:
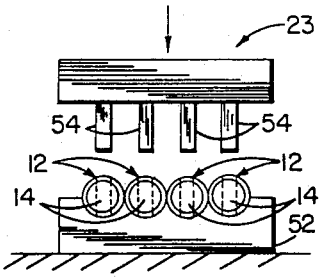
FIG. 7 is a somewhat schematic front elevational view of a tool for piercing the conductors.

Pre-pierced pilot holes 22, 22 preferably extend through each conductor 14 and may be pierced in the conductor before it is assembled with the housing using a tool, such as the tool indicated generally at 23 and illustrated somewhat schematically in FIG. 7. The tool 23 includes a stationary member 52, for supporting the various insulated conductors 14, 14 in generally adjacent parallel relation to each other, and a movable gang punch 54, which is operative to simultaneously pierce the required tine receiving openings 22, 22.

In accordance with the presently preferred method for practicing the invention, the pilot holes are formed after the cable 12 has been inserted into the connector element 10. The connector housing 16 is firmly supported while punches (not shown) inserted through the slotted openings in the top wall 28 between the spacers 38, 38 simultaneously pierce the various pilot holes 22, 22 in the conductors 14, 14. This procedure assures that the various pilot holes 22, 22 are properly positioned relative to the connector element 10 to receive the contacts 18, 18.

After the pilot holes 22, 22 have been formed in the various conductors 14, 14 and while the cable 12 is in assembled relation within the housing 16, the various contacts 18, 18 are inserted through the slotted openings in the top wall and are or may be simultaneously driven by a suitable tool into assembly with the conductors 14, 14 to effect press fit engagement of the various tines 20, 20 within the pilot holes 22, 22.

The pilot holes 22, 22 in the various conductors are, of course, slightly smaller than the tines 20, 20 to be received therein to effect proper press fit assembly. This arrangement assures gas tight connection between each contact 18 and its associated conductor 14. As best shown in FIG. 6, some of the metal which comprises the conductor 14 is displaced or caused to flow as the contact tines 20, 20 are pressed into assembly with the conductor. In assembly, each tine 20 extends through its associated conductor 14 and through the insulation layer 26 which surrounds the conductor. Thus, edge portions of each tine form four gas tight junctions at the points of entry and four gas tight junctions at the points of egress from the associated conductor 14 whereby to assure positive contact with the conductor while reducing the risk of corrosion occurrence between coengaging surfaces of the contact 18 and the conductor 14.

Termination is completed by inserting an appropriate tool or tools into the recesses 40 and 42 to force the strain relief portions 44 and 46 into tight gripping engagement with associated portions of the cable 12, as best shown in FIG. 3. The latter tool, or tools may be arranged to cause some melting or deformation of the strain relief portions, in a manner well known in the art.

Figure 8:
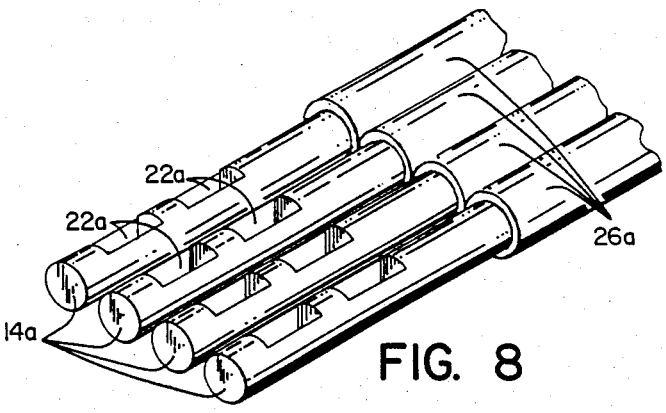
FIG. 8 is a somewhat enlarged fragmentary perspective view of an electrical cable pre-pierced in accordance with a method of the present invention.
Figure 9:
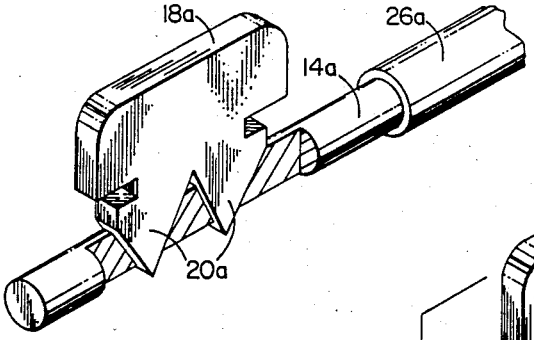
FIG. 9 is a somewhat enlarged fragmentary perspective view showing a typical electrical contact connected to one of the solid conductors shown in FIG. 8, the conductor being shown partially in axial section.

In some instances it may be desirable to strip the insulation from the various conductors to expose bare portions of the conductors before pilot holes are formed therein. In FIGS. 8 and 9 there is shown a portion of another electrical cable **12*a* wherein pilot holes 22*a*, 22*a* are formed in bare end portions of solid conductors 14*a*, 14*a* from which insulation 26*a*, 26*a*** has been stripped.

Figure 10:
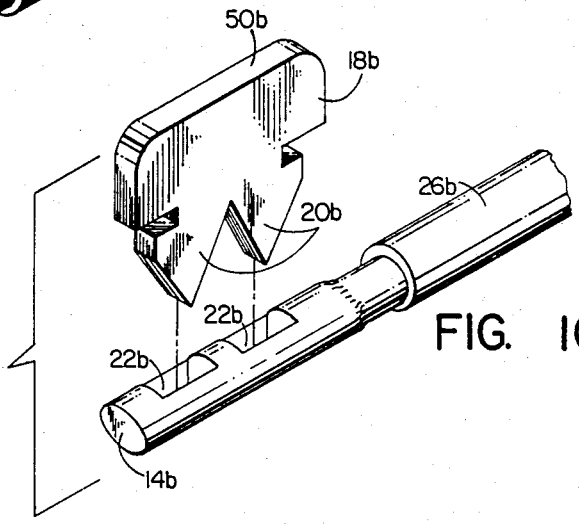
FIG. 10 is an exploded fragmentary perspective view of another embodiment of the invention and illustrates still another method for practicing the invention.
Figure 12:
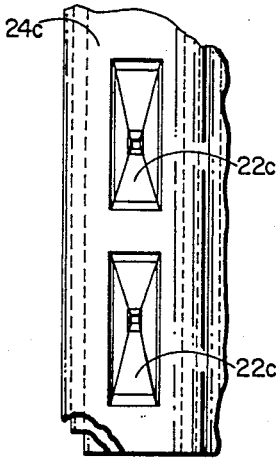
FIG. 12 is a somewhat enlarged fragmentary plan view of the electrical cable shown in FIG. 11.
Figure 11:
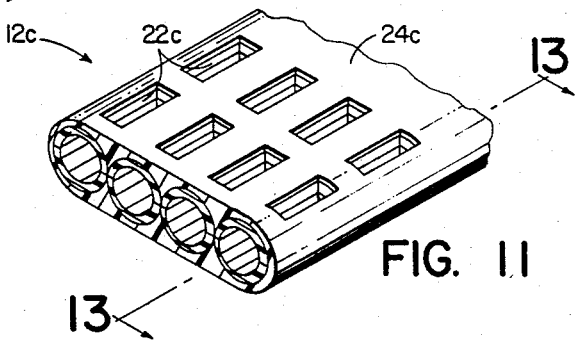
FIG. 11 is similar to FIG. 8 but shows another electrical cable pre-pierced in accordance with a method of the present invention.
Figure 13:
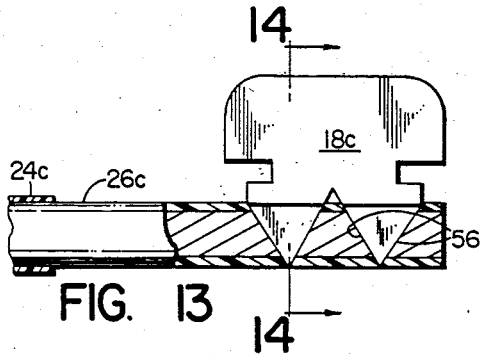
FIG. 13 is a fragmentary sectional view taken along the line 13—13 of FIG. 11 and shows the cable with a contact assembled therein.
Figure 14:
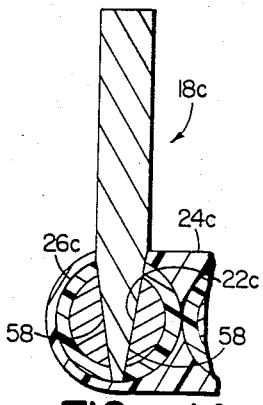
FIG. 14 is a somewhat further enlarged sectional view taken along the line 14—14 of FIG. 13.

Referring now to FIG. 10, there is shown another method of practicing the invention wherein an associated portion of each individual pre-stripped conductor **14*b*, is deformed to increase its lateral dimensions before pilot holes 22*b*, 22*b* are pierced in the conductor. It may be desirable to use this method where the conductors to be pre-pierces are of very small gauge. Suitable insulation barriers are or may be provided between the adjacent conductors 14*b*, 14*b*** and may, for example, comprise integral partitions or separators which form part of a connector element utilized to effect termination of the conductors.

If desired, a tapered lead may be provided on each tine to aid in assemblying the contacts with associated conductors and such an arrangement is illustrated in FIGS. 11–14. A typical contact indicated at **18*b* has tapered generally V-shaped tines 20*c*, 20*c*. Each tine is defined by a pair of V-shaped end walls 56, 56 and a pair of V-shaped side walls 58, 58 which converge or taper to the apex of the tine. The pilot holes 22*c*, 22*c* in the individual conductors 14***c*, 14*c* which comprise the cable 12*c* are formed in a like manner to generally complement the tines. Specifically, each pilot hole is tapered, has a generally rectangular cross section, and is defined by generally V-shaped side walls and generally V-shaped end walls. Thus, the contacts 18*c*, 18*c* will be substantially self-aligning when assembled into press fit engagement within the associated tapered pilot holes 22*c*, 22*c*.

I claim:

1. A method for terminating solid electrical conductors comprising the steps of arranging end portions of said conductors in closely spaced parallel relation to each other, forming at least one pilot hole in each one of said conductors, providing a plurality of contacts having tines thereon, and assembling each one of said contacts with an associated one of said conductors by forceably inserting the tines on said contacts into the preformed pilot holes in said conductors.

2. A method for terminating solid electrical conductors as set forth in claim 1 wherein the step of forming is further characterized as forming at least one pilot hole extending through each one of said conductors.

3. A method for terminating solid electrical conductors as set forth in claim 1 wherein each of said contacts has a plurality of tines thereon and the step of forming is further characterized as forming a plurality of axially spaced pilot holes along the axis of each one of said conductors equal in number to the tines on an associated one of contacts.

4. A method for terminating solid electrical conductors as set forth in claim 1 wherein each one of said conductors has a dielectric insulation jacket thereon and the step of forming is further characterized as forming at least one pilot hole in each one of said conductors and through the insulation jacket on said one conductor.

5. A method for terminating solid electrical conductors as set forth in claim 1 including the additional step of deforming an associated portion of each one of said conductors to increase the lateral dimension of said associated portion and the step of forming is further characterized as forming at least one pilot hole in each associated portion.

6. A method for terminating solid electrical conductors as set forth in claim 1 wherein the step of forming is further characterized as simultaneously forming at least one pilot hole in each one of said conductors.

7. A method for terminating solid electrical conductors as set forth in claim 1 wherein the step of forming is further characterized as piercing each one of said conductors to form at least one pilot hole therein.

8. A method for,terminating solid electrical conductors as set forth in claim 7 wherein the step of piercing is further characterized as supporting said conductors in closely spaced parallel relation to each other and punching pilot holes in the supported conductors.

9. A method for terminating solid electrical conductors as set forth in claim 1 wherein the step of arranging is further characterized as arranging end portions of said conductors in closely spaced parallel relation within an associated electrical connector element and the steps of forming and assembling are performed after the step of arranging.

10. A method for terminating solid electrical conductors as set forth in claim 9 wherein the step of forming is further characterized as simultaneously piercing at least one pilot hole in each one of said conductors after said end portions are arranged within said associated electrical connector element.

11. An article of manufacture comprising a plurality of solid electrical conductors having end portions disposed in closely spaced parallel relation to each other, each of said end portions having at least one pre-formed tine receiving opening therein, a plurality of electrical contacts, each of said contacts having at least one tine thereon, each of said contacts being assembled with an associated one of said solid conductors and having said one tine disposed within said one pre-formed opening in said one conductor and in press fit relation to said one conductor.

12. An article of manufacture as set forth in claim 11 wherein said contacts are arranged in in-line relation to each other along a line extending transversely of the axes of said conductors.

13. An article of manufacture as set forth in claim 11 wherein said one opening extends through said end portion.

14. An article of manufacture as set forth in claim 11 wherein said one tine generally complements said one pre-formed opening.

15. An article of manufacture as set forth in claim 11 wherein each one of said end portions has a plurality of axially spaced apart opening and each of said contacts has a plurality of tines, each of said tines being received within an associated one of said openings and in press fit relation to an associated one of said conductors.

16. An article of manufacture as set forth in claim 11 wherein said one preformed opening comprises a generally axially disposed slot.

17. An article of manufacture as set forth in claim 16 wherein said slot extends diametrically of said conductor axis.

18. An article of manufacture as set forth in claim 11 wherein said one opening comprises a generally V-shaped slot.

19. An article of manufacture as set forth in claim 18 wherein said one tine is generally V-shaped and complements said slot.

20. An article of manufacture as set forth in claim 18 wherein the walls of said V-shaped slot are tapered in the direction of the apex of said V-shaped slot.

21. An article of manufacture comprising a connector element and an electrical cable including a plurality of axially elongated solid electrical conductors terminated by said connector element, said connector element having a housing and a plurality of electrical contacts mounted in said housing and electrically insulated from each other, each of said contacts having at least one tine thereon and a contact surface exposed externally of said housing, said cable extending into said housing, said conductors having parallel portions disposed within said housing, said portions having a pre-formed tine receiving openings therein, said tines being assembled in press fit relation with said conductors within said openings in said conductors.

22. An article of manufacture as set forth in claim 21 wherein said tine receiving openings extend through said conductors.

23. An article of manufacture as set forth in claim 21 wherein said tine receiving openings comprise axially elongated slots in said conductors.

24. An article of manufacture as set forth in claim 23 wherein said slots are further characterized as generally Vshaped slots.

25. An article of manufacture as set forth in claim 24 wherein said V-shaped slots are defined by converging walls of said conductors.

26. An article of manufacture as set forth in claim 24 wherein said tines are generally V-shaped and generally complement said V-shaped slots.

27. An article of manufacture as set forth in claim 21 wherein said contacts are arranged in alignment along a line extending transversely of the axes of said conductors.

28. An article of manufacture as set forth in claim 27 wherein said contacts are electrically isolated from each other by walls of said housing.

* * * * *